United States Patent [19]

O'Brien

[11] Patent Number: 4,781,144

[45] Date of Patent: Nov. 1, 1988

[54] OFF-SHORE DRILLING INSTALLATION EVACUATION SYSTEM

[76] Inventor: Daniel P. O'Brien, 4 Jensen Camp Road, St. John's, Newfoundland, Canada, A1E 3G3

[21] Appl. No.: 928,690

[22] Filed: Nov. 7, 1986

[30] Foreign Application Priority Data

Dec. 4, 1985 [CA] Canada ..... 494860

[51] Int. Cl.[4] ..... B63B 23/04

[52] U.S. Cl. ..... 114/365; 114/371; 114/373; 182/12; 182/47

[58] Field of Search ..... 114/258, 259, 261, 262, 114/44, 48, 365, 368, 370, 371, 373, 376, 264, 265, 230; 405/1, 3, 4; 182/10, 47, 48, 12

[56] References Cited

U.S. PATENT DOCUMENTS

| | | | |
|---|---|---|---|
| 582,069 | 5/1897 | Leslie . | |
| 609,532 | 8/1898 | Cappellini . | |
| 1,129,751 | 2/1915 | Standau | 114/348 |
| 1,827,534 | 10/1931 | McKenzie | 114/373 |
| 2,091,317 | 8/1937 | McPartland . | |
| 2,398,274 | 4/1946 | Albert . | |
| 2,768,598 | 10/1956 | Harris | 114/262 |
| 3,433,323 | 3/1969 | Ukawa | 182/48 |
| 3,608,754 | 9/1971 | Park | 405/1 |
| 3,819,011 | 6/1974 | Kinase et al. | 182/48 |
| 3,880,254 | 4/1975 | Fitzgerald et al. | 182/10 |
| 4,365,579 | 12/1982 | Perez | 114/349 |
| 4,480,575 | 11/1984 | Delamare | 114/230 |
| 4,522,144 | 6/1985 | Klem | 114/378 |
| 4,602,697 | 7/1986 | Aanensen | 182/48 |

FOREIGN PATENT DOCUMENTS

| | | | |
|---|---|---|---|
| 479057 | 2/1916 | France | 114/373 |
| 332690 | 7/1930 | United Kingdom | 114/373 |
| 2108054 | 5/1983 | United Kingdom | 114/349 |
| 2123353 | 2/1984 | United Kingdom | 114/373 |
| 2135272 | 8/1984 | United Kingdom | 114/373 |

OTHER PUBLICATIONS

"Mariner's Annual" catalogue, 1983, pp. 1061–1065.

*Primary Examiner*—Joseph F. Peters, Jr.
*Assistant Examiner*—Thomas J. Brahan
*Attorney, Agent, or Firm*—Mason, Fenwick & Lawrence

[57] ABSTRACT

There is provided a new and useful offshore evacuation system for drilling rigs or platforms comprising a launch structure for a survival craft; the structure comprising at least one support strut adapted to be pivotally attached at one end thereof to the platform superstructure and carrying at the other end thereof at least one support cradle for survival craft, and rotatable between an upper position and a lower position; and means for effecting rotation of said launch structure from said upper to said lower position; and a closed companionway leading from the platform accommodation unit to the loading position of the survival craft and being in sealing relationship with the survival craft.

20 Claims, 6 Drawing Sheets

OFF-SHORE DRILLING INSTALLATION EVACUATION SYSTEM

This application relates to evacuation systems for offshore drilling platforms.

BACKGROUND OF THE INVENTION

The offshore drilling industry and the technology associated with it have developed rapidly in the last twenty years. The drilling rigs in use today have evolved into sophisticated structures, designed and built to withstand the severest of environmental conditions and to operate in very deep waters. Advanced computer technology has contributed substantially to bring platform development to its present position. Computers are integral, for example, to the collection and evaluation of geological and seismic date, to the operation of dynamically positioned platforms, and to methods of well control.

In spite of the advanced state of technology, accidents requiring evacuation from drilling platforms still occur. Such accidents may include, for example, fire on board. In addition to this type of accident, environmental conditions off certain coasts, such as off Eastern Canada, are especially severe with extremes of wind and wave, and a frequency of storms above that found in other areas. Both accidents and weather conditions may necessitate evacuation of the platform. Such occurences have in recent years lead to loss of life by virtue of the inadequacies of the evacuation systems.

Unfortunately, evacuation systems and the component parts of those systems have not kept pace with the rapid development of technology in the platform itself. There are currently, in particular, shortcomings in all three major components of evacuation. These components are the mustering and boarding procedure, the launch and the removal of the survival craft from the area of the platform. As a result, there is a critical need for a safe means of evacuation of a drilling platform in last resort situations.

PRIOR ART

A number of systems for evacuation of ocean-going vessels have been devised over a long period of years. These generally have been concerned with the specific manner of launch of lifeboats from ships.

Among early examples is that illustrated in U.S. Pat. No. 582,069, granted May 4, 1897, to Leslie, and illustrating a launch system in which a pair of davits of elongated configuration are attached to pivot downwardly from a ship's side to launch a lifeboat at some distance from the ship. The boat simply floats off the davits as they are lowered into the water.

A similar example is illustrated in U.S. Pat. No. 609,532, issued Aug. 23, 1898 to Cappellini. That patent illustrates a similar pair of pivoting davits which in this case are controlled in their descent by a hydraulic system. Of note in this early patent is the system allowing the ship's captain to launch the lifeboats from the bridge through a series of exploding blocks. The lifeboat will be deposited at some distance from the side of the ship.

U.S. Pat. No. 2,091,327, issued Aug. 31, 1937, to McPartland illustrates a further example of the rotating davit type of launch system which deposits the lifeboat some distance from the side of the ship. The boat simply floats off the davit as the davit is lowered toward water level.

Finally, U.S. Pat. No. 2,398,274, issued Apr. 9, 1946, to Albert, illustrates a launching and pick-up device for patrol boats, launches or the like. The launching and pick up platform is mounted on rotating davits and is lowered by a series of cables connected to the davits and the platform. The boat simply floats off the platform when the platform is lowered below water level. In this case the small boat is launched quite close to the mother ship. Of note, the direction of launch is such that the launched boat enters the water with a direction of travel aimed directly at, or, presumably, away from the mother ship.

In all these cases the systems include means for maintaining the trim of the survival craft during launch.

More recently, evacuation systems have been proposed for offshore drilling platforms which incorporate a number of the features of these early patents, including a rotating davit fixed to the side of the platform. Other proposals include free-fall type systems in which the escape craft is launched by free fall from tracks near the surface of the platform.

None of these systems deal adequately with the range of problems which must be addressed in order to establish a safe and reliable system.

Accordingly, the present system has been developed to overcome problems inherent in various of the prior art systems.

SUMMARY OF THE INVENTION

A system has now been developed which in its various embodiments is directed at improvements in the ability of personnel to board a survival craft, in the launch structures and procedures, in removal after launch from the area of the platform and in survival craft location by rescue ships when at sea.

Accordingly, in a first embodiment the invention provides an offshore evacuation system for drilling rigs or platforms comprising a launch structure for survival craft; the structure comprising at least one support strut adapted to be pivotally attached at one end thereof to the platform superstructure and carrying at the other end thereof a support cradle for survival craft, and rotatable between an upper position and a lower position; and means for effecting rotation of said launch structure from said upper to said lower position; and a closed passageway leading from the platform accommodation unit to the loading position of the survival craft and being in sealing relationship with the survival craft.

In a further embodiment, there is provided an offshore evacuation system for drilling rigs or platforms comprising a launch structure for a survival craft; the structure comprising at least one support strut pivotally attached at one end thereof to the platform superstructure and carrying at the other end thereof a support cradle for a survival craft; the structure rotatable between an upper load position and a lower launch position and means for effecting rotation of said launch structure from said upper to said lower position; and an onboard computer for said survival craft for monitoring environmental and platform conditions and for controlling the launch of said survival craft.

GENERAL DESCRIPTION OF THE INVENTION

A number of specific problems can readily be isolated which require solutions in the optimum system. A first problem lies in getting the crew to the boats in the most expeditious and safest manner. A second problem is in providing in the boat a "safe haven" prior to launch which enables the crew to delay launch to the last possible minute. A third problem is in reducing the complexities of launch and removing to as a great an extend as possible the human element. During launch it is essential that the boat be deposited at a safe distance from the platform to avoid collisions with the platform after launch. Finally, the problem of navigation following launch must be addressed, again to avoid collisions with the platform and to allow for quick location and retrieval of the boat from the sea. A complete system must deal with all of these problems, and the present invention in its various embodiments addresses these difficulities.

In broad form as noted above the invention includes a launch system for a totally enclosed motor propelled survival craft. Some such craft are known and others are under development. They must meet rigid regulatory requirements and they are not in themselves the subject matter of the present invention. The basic system may be enhanced by a closed companionway entry system to the craft and a computer controlled evacuation sequence.

The mechanical aspect of the launching system includes a rotating davit arrangement which is secured for rotation to the platform girders. Lowering of the davits is accomplished by means of a winch and cable arrangement. The preferred configuration for the davit system is an inverted V shape with a support member extending from the top thereof. While the preferred configuration is one in which the launch structure would accommodate a single survival craft only, it is also contemplated that the structure could if required accommodate a pair of survival craft. The single boat configuration is preferred because of a general feeling that larger craft are safer. However, particularly in a transition period where it might be economically attractive to utilize a platform's existing boats, the structure can be adapted to a two boat situation.

In the preferred case where a single survival craft is utilized, the support member at the top of the inverted V-shaped davit carries a U-shaped cradle support. Attached for rotation within the arms of the U-shaped cradle support is a survival craft support cradle. The cradle rotates to maintain the longitudinal axis of the craft in a horizontal position; i.e., to maintain trim, and, when the support structure pivots down to water level and below, the rescue craft simply floats off the cradle.

The permanent support structure in the loading area of the craft preferably includes a pair of stanchions with arms extending above the survival craft to secure the craft in the cradle prior to lowering.

The launch sequence is preferably computer controlled. When the survival craft is loaded and the latch manually closed, the computer begins to monitor and control the launch. Various control sequences can be proposed, and that discussed here is by way of example.

Upon sensing that the survival craft hatches are all sealed and closed, the computer provides suitable signals to the control person. When the first steps have been verified the computer will indicate that the craft is ready for launch.

As indicated, the survival craft satisfies the safe haven concept. That is to say, the craft provides an airtight enclosure which enables the platform crew to take refuge within the craft to avoid hazardous gases, fire and the like. Once the crew is in the craft with hatches closed, the actual launch of the craft can be delayed until it is determined that remaining with the platform will endanger the lives of the crew members. Since evacuation of the platform will only take place during time of maximum stress on crew members, it is highly desirable that the escape procedure be as automated as possible. It is for that reason that the present invention contemplates the availability of a launch sequence controlled entirely by computer. Obviously, the system is always subject to a manual override. The following descirbes generally the additional functions which can advantageously be carried out under microprocessor control.

When the survival craft is fully loaded or is otherwise ready for launch, as indicated by the sealing of the hatches on the craft, the launch sequence can shift to computer control. As a first step in this sequence, as indicated above, the microprocessor may ensure that weight distribution in the craft is acceptable for launch. This would be of particular importance in those situations where the craft was only partially filled.

The control system would then by visual and/or audible signal indicate that the craft is ready for launch. It is then necessary for the critical decision to be taken by the control person as to whether the crew is to remain in the survival craft as a safe haven at the platform or to continue with a full fledged evacuation. This decision is clearly based on a number of factors dealing with conditions exterior to the survival craft. For example, such data as time, wind speed and direction, wave height, general sea state, trim and list condition of the rig, condition of the well, presence of hazardous gases or fire are all factors which will influence a decision to abandon a rig. All such conditions are remotely monitored by the survival craft onboard computer.

Assuming a decision is made to evacuate the platform, a launch sequence initiator switch will be activated. Such a switch is preferably in the form of a large area push button. The reduced manual dexterity coincident with the wearing of an immersion suit requires that such switches be readily accessible with limited manipulation.

The second step in the automatic procedure contemplates a series of system activation steps. These include engine start up, sprinkler system activaton (may be delayed until craft is launched), onboard compressed air system activation (to create a positive pressure inside the survival craft to ensure that no hazardous gases are drawn in), and activation of the radio directional finder (RDF). The onboard computer through the RDF or the onboard compass automatically controls the course of the survival craft. A signal is received by the RDF from the platform standby vessel which will have positioned itself to effect rescue from the survival craft, following launch, and the survival craft will automatically set a course for the standby vessel.

In the preferred situation the survival craft is provided with a radar transponder to aid in location of the craft in the water by a rescue vessel.

Initiation of these systems completes preparation for launch, and a further visual and/or audible signal indicates this state of final readiness to the control person. Assuming the launch is to go forward, an actual launch initiation switch is activated. The effect of this action is to release the brake on the launch cable winch to thereby begin the lowering of the support frame. The frame is lowered at a controlled rate and, when it reaches water level, the survival craft simply floats off its cradle. The support frame continues to lower into the water to ensure that it is well clear of the survival craft. At this point the craft engine is at full throttle to ensure that the craft is not swept back into collision with the platform structure. The engaging of the transmission of the survival craft power train and application of full throttle is achieved automatically upon separation of the craft from the cradle. At this point a preprogrammed compass course followed after a preset time interval by an RDF signal from the standby vessel guides the survival craft away from the platform and toward the standby vessel.

A further preferred feature of the present invention is the presence of an enclosed airtight companionway connected through airtight seals at one end to the rear entry of the survival craft and at the other end to the accommodation area of the platform. This companionway provides protected and hazard-free access to the survival craft, thereby avoiding both the obstructions which arise from time to time on deck areas, and adverse environmental conditions, including fire and hazardous gases. The companionway is provided with emergency lighting and also acts as a heated storage area for immersion suits and lifejackets. Along with those stored in the accommodation area, the supply is sufficient to comply with regulatory requirements. Preferably the suits and jackets stored in the sealed companionway are in addition to the regular complement stored in the accommodation area.

It is much preferred that a single survival craft be utilized, since conditions prevailing at the time of an evacuation are such that difficulties in accounting for crew members are dramatically deceased by having a single assembly point. As well, the task of the standby vessel in dealing with the survival craft is simplified where only one such craft is present in the water.

A further distinct advantage to the use of a single larger craft is in its added space and seaworthiness. Both factors contribute to passenger morale and reduce the likelihood of seasickness.

Nonetheless, it is contemplated that a second and similar unit can be provided at the opposite end of the platform to be used as a backup unit should conditions prevent the crew from reaching the primary craft.

BRIEF DESCRIPTION OF THE DRAWINGS

In drawings which illustrate embodiments of the invention.

Figure 1:
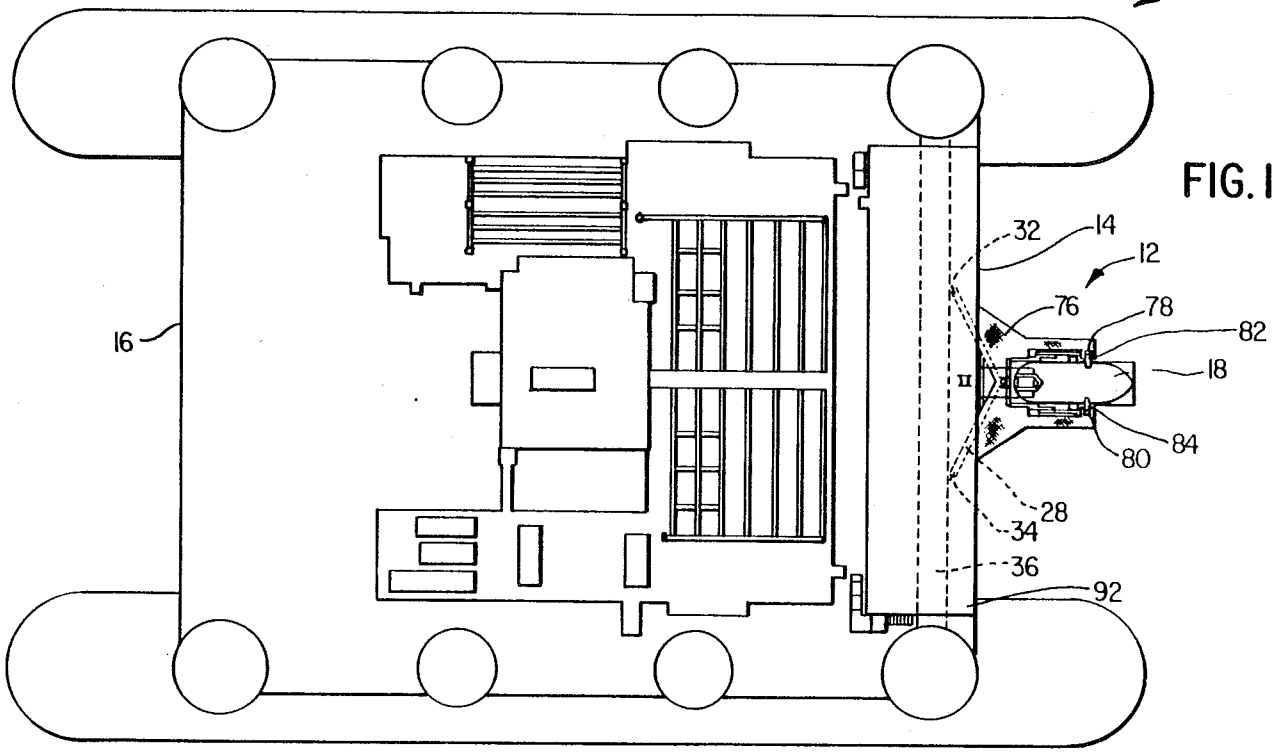
FIG. 1 is a top plan view of a semisubmersible drilling platform incorporating the system of the invention.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the following description, similar features in the drawings have been given similar reference numerals.

The drilling platform 10 is typical and is therefore useful in describing the invention. However, it will be readily apparent that the invention is applicable to a wide variety of drilling platforms having various specific configuraitons and layouts. The illustrated platform will therefore not be described in detail, the detail being apparent to those skilled in the art.

As illustrated, the evacuation structure 12 is installed at the bow 14 of the platform 10. In the preferred case a similar structure would be installed at the stern 16 of the platform 10. Each such structure would support a survival craft 18 capable of accommodating the entire crew of the platform 10. The usual required standard for evacuation capacity is two hundred per cent of the platform's complement. Accordingly, the installation of two of the systems of the invention, one at bow and one at stern, would fulfill this requirement.

The major components of the evacuation system of the present invention include the survival craft support structure 20, the onboard computer 22 (not illustrated), and the closed passageway 24. The totally enclosed motor propelled survival craft 18 is not in itself a part of the invention, inasmuch as conventional such craft could be modified to fit into the inventive system. It should be emphasized that it is not necessary that all of these components be present for all applications of the inventive system. For example, in some cases the closed passageway may not be present, although it is not to be implied that it is not highly preferable that the passageway be present in all cases. As well, in certain applications the onboard computer control functions may be modified or absent, although, again, it is highly preferable that the complete system be present in all cases.

Figure 3:
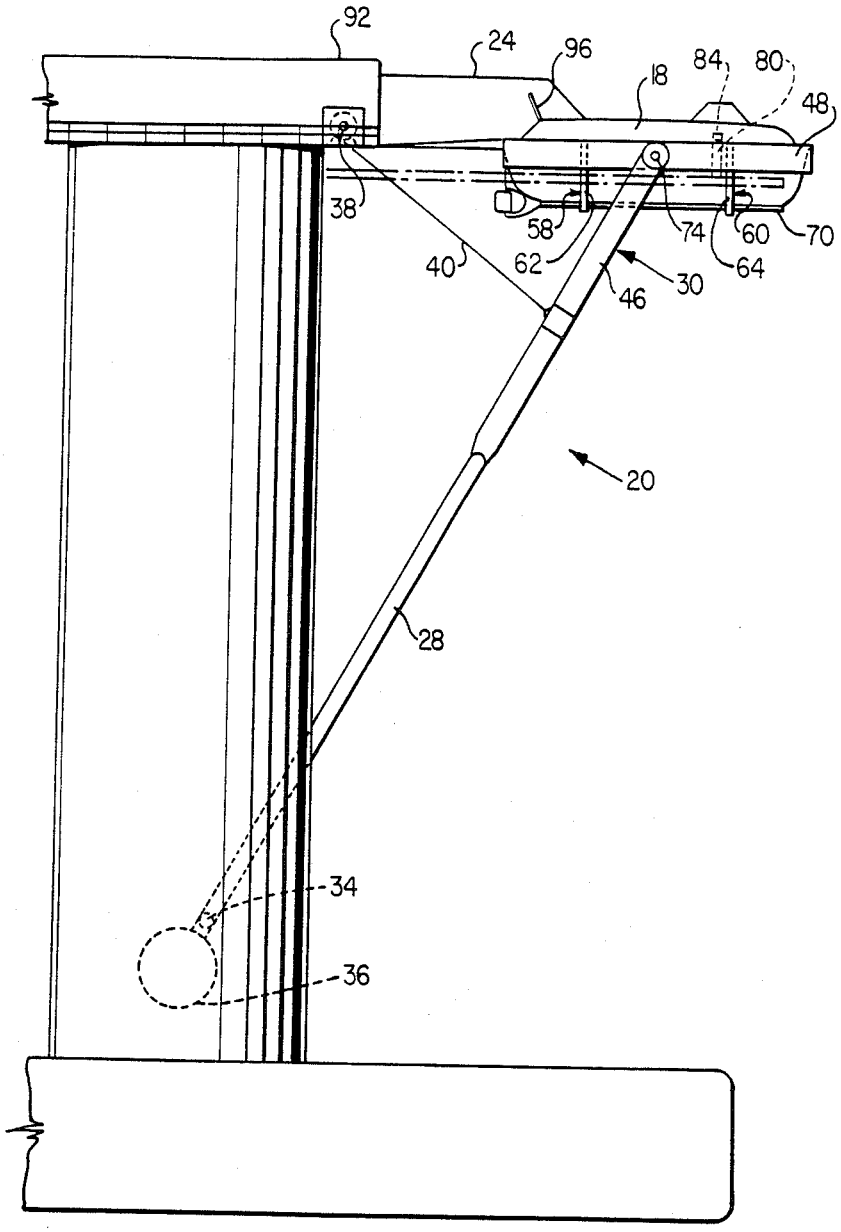
FIG. 3 is a side elevation of a survival craft support structure in the raised position.
Figure 4:
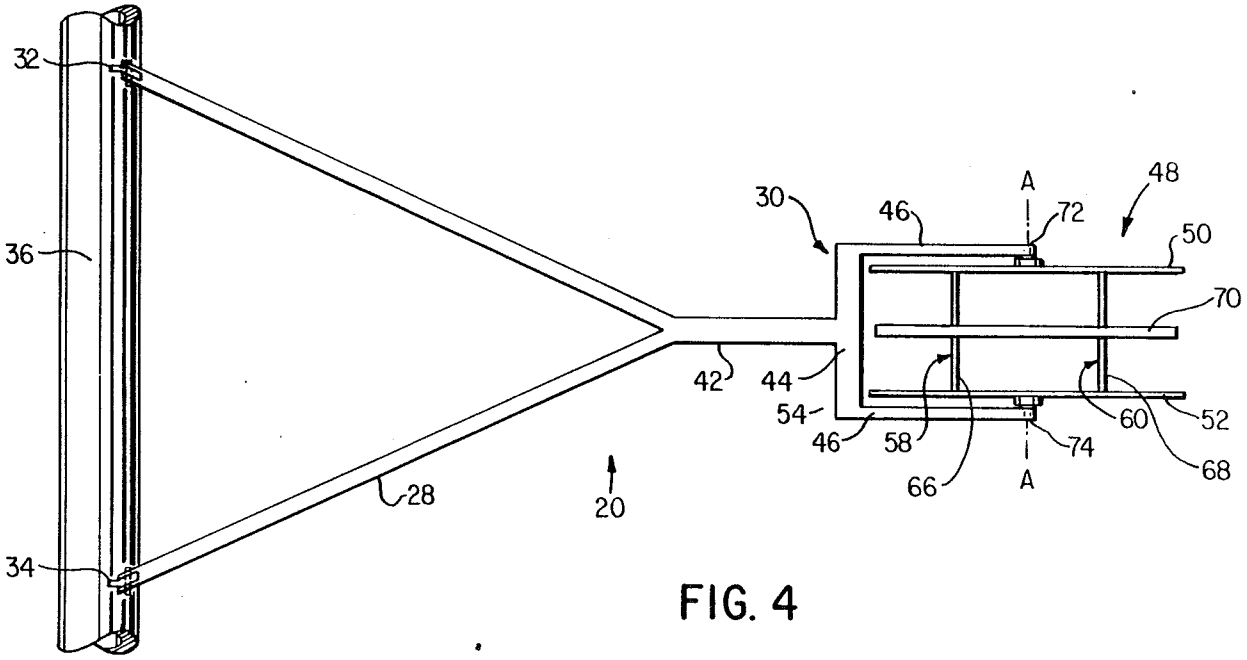
FIG. 4 is a top plane view of a survival craft support structure and cradle.

With particular reference to FIGS. 3 and 4, the survival craft support structure 20 comprises the extended A-frame 28 and the cradle support structure 30. The A-frame 28 is rotatably connected at 32 and 34 on the main transverse girder 36. The main transverse girder 36 is at approximate pontoon level on a semisubmersible platform.

The rotation of the A-frame 28 is controlled by a winch and cable system comprising a winch 38 at deck level and a cable 40 secured to the A-frame 28 or the cradle support structure 30.

The cradle support structure 30 comprises an extension 42 to the A-frame 28, a transverse member 44 secured across the end of extension 42, and pair of upstanding arms 46. Structure 30 is in the plane of the A-frame 28.

Rotatably connected to the arms 46 is a survival craft support cradle 48. The cradle may take any of a large number of configurations but in one of its simpler forms as illustrated consists of a pair of elongated elements 50 and 52 from which are hung a pair of slings 58 and 60 each comprising a pair of vertical members 62 and 64 and transverse members 66 and 68. Vertical members 62 and 63 are of such length that elongated elements 50 and 52 are positioned immediately below the gunwales of the survival craft 18. The positioning of elements 50 and 52 with respect to the gunwales prevent the craft 18 from falling off of cradle 48 should the rig or platform sustain a significant list. Fixed to the transverse members 66, and 68 is a keel support member 70 which engage the keel or bottom of the hull of the survival craft 18. The survival craft 18 rests within this support cradle 48. As clearly illustrated in the drawings, no part of the launch structure extends above survival craft 18. As well, the cable 40 is attached to A-frame 28 or cradle support structure 30 below the level of support cradle 48.

The support cradle 48 is rotatably attached to the upstanding arms 46 by means of the pivot mechanisms 72 and 74 on the horizontal axis AA. Mechanisms 72 and 74 are such as to maintain the trim position of the support cradle 48 and thus of the survival craft 18 during the course of lowering the craft 18 into the sea. This is preferably achieved by a positive gear train which will not be susceptible to wind or water effects. A cable and reel system would also be very suitable.

It should be noted that the A-frame structure was chosen to provide adequate strength in the transverse direction. It is not of critical importance, however, that this particular configuration of structure be provided. It is only necessary that the structure have the pivoting capability and the strength required to withstand wind and wave effects.

Figure 5:
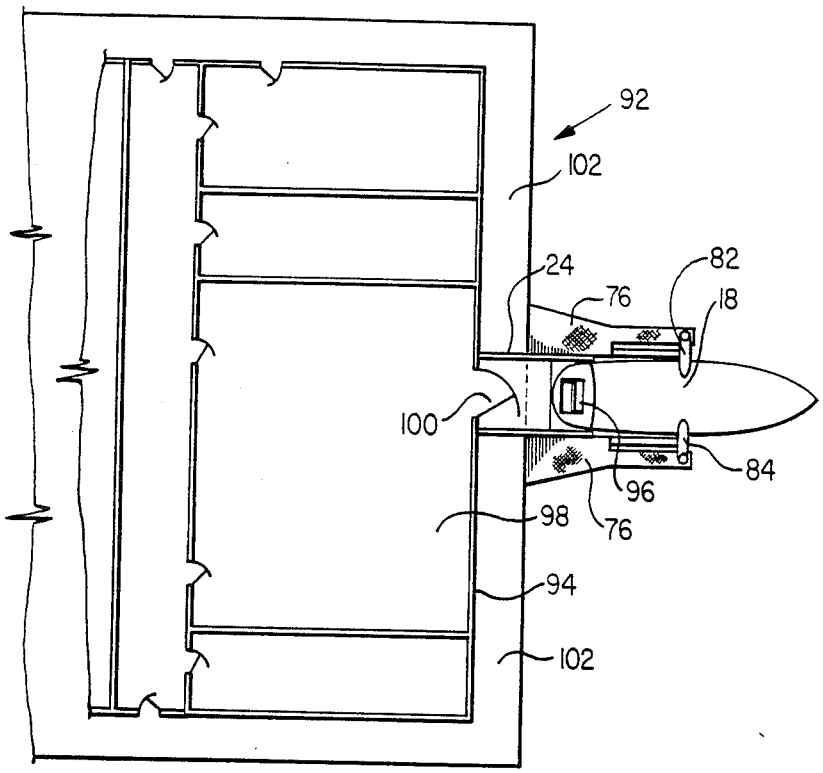
FIG. 5 is a plan view of a platform accommodation area including an evacuation companionway.

As illustrated particularly in FIGS. 1 and 5, a decking structure 76 is provided at platform deck level to provide access to the survival craft 18 and to the support cradle 48 for maintenance purposes. As well, the decking structure 76 provides a support for the closed passageway to be discussed below.

In order to maintain the survival craft 18 securely in the support cradle 48 when in the storage position, at least one pair of stanchions 78 and 80 are provided extending upwardly from the decking structure 76. These stanchions include at the top thereof transversely extending members 82 and 84. These last contact the upper structure of the survival craft 18 and maintain its position. When a launch takes place, the support cradle 48 with the survival craft 18 simply drops away from members 82 and 84, leaving the craft 18 free to float off the cradle when the cradle is lowered into the water.

The survival craft 18 may take any one of a large number of configurations. All of these must meet applicable government regulations. As a minimum all will be totally enclosed and motor propelled. A positive pressure is maintained in the craft when in use to ensure that hazardous gases are not drawn inside. The craft is preferably equipped with individual high-backed seats with a four-point safety harness.

Figure 6:
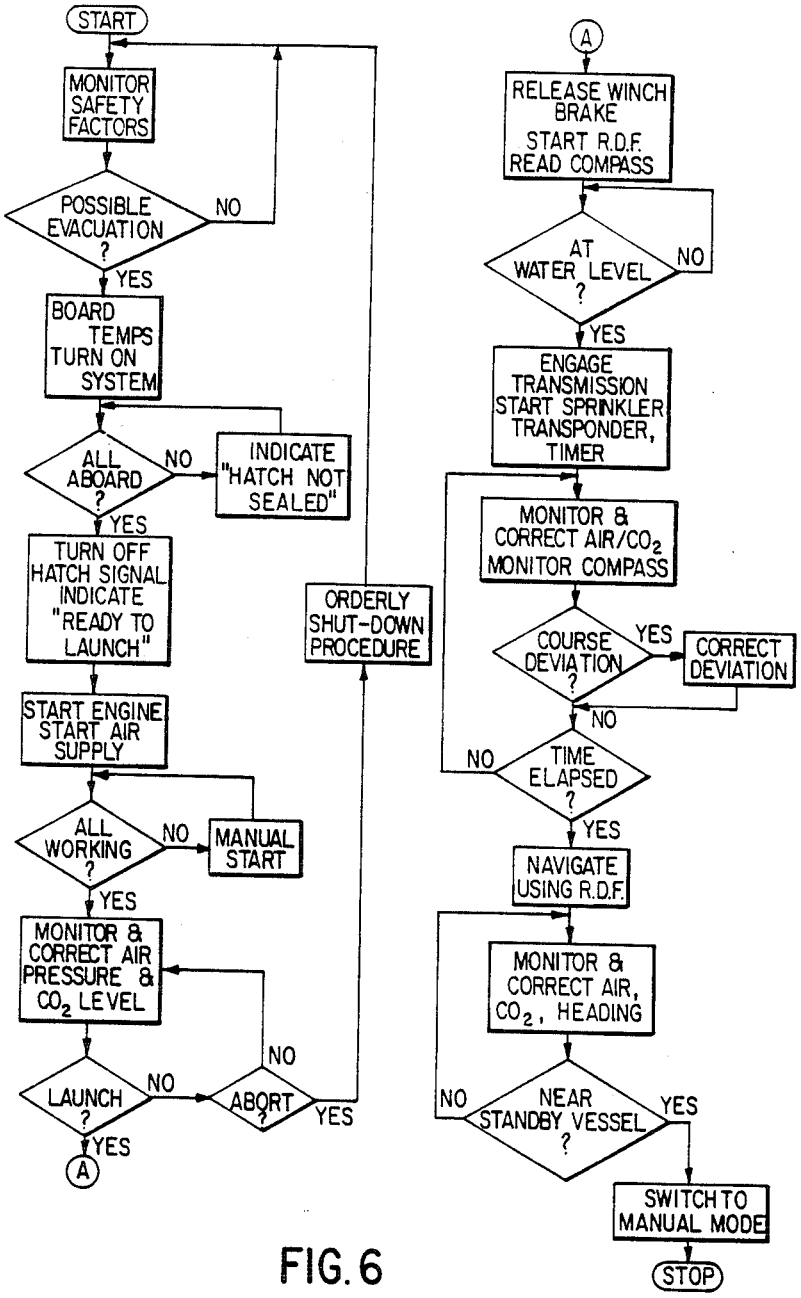
FIG. 6 is a flow chart for one embodiment of the computer controlled launch sequence.

It is much preferred that the sequence of steps necessary to launch the survival craft be controlled by an onboard computer. The computer will have an onboard power supply but will be capable of interfacing with the drilling platform main computer. The following evacuation sequence is typical of those which might be utilized. The system is flow charted in FIG. 6. When an evacuation alarm sounds, all crew members will proceed to the survival craft 18, picking up immersion suits and lifejackets en route. When all crew members are accounted for the survival craft hatch will be closed and sealed. At this point the onboard computer becomes an integral part of the evacuation procedure. Following confirmation by the onboard computer that the entry hatch or hatches have been sealed, the computer will indicate that the survival craft is ready for launch.

It is then necessary for the control person to come to a final decision relative to evacuation. The onboard computer will provide information from various sources which will place the control person in a position to come to a decision. The computer, as indicated above, will monitor a substantial number of environmental factors and other indicators of the condition of the platform. For example, these will include wind speed and direction, wave height, general sea state, trim and list condition of the rig, information relative to the well and data relative to the presence or absence of hazardous gases.

All switches and controls, whether of the push button, lever or other type, are designed to enable easy operation by an operator enclosed in an immersion suit and lifejacket. The immersion suit substantially reduces manual dexerity, so that large and readily accessible controls are essential.

If a decision is made to proceed with evacuation, a switch is activiated to initiate the launch sequence. The computer will then activate a number of systems in preparation for survival craft launch. These functions preferably include the start up of the engine, activation of the onboard compressed air system and activation of the radio directional finder (RDF).

At this point the computer monitors internal air pressure and $CO_2$ levels and makes appropriate adjustments.

When this series of steps has been completed, completion is indicated to the control person via a visual and/or audible indicator. the control person then activates a launch switch. The computer then releases the cable winch brake and the cable 40 is fed out at a controlled rate to lower the support structure 20. That structure pivots about the connecting points 32 and 34 on girder 36 and the survival craft 18 arcs outwardly and downwardly in the support cradle 48 away from the platform 10.

As the support structure reaches and slips below the surface of the sea, the survival craft floats off the cradle 48. The structure 26 continues to pivot below the surface of the sea so that there is no possibility of further interference with the survival craft 18.

At the same time, the computer engages the survival craft transmission and applies maximum power to the survival craft engine. The survival craft then begins to move directly away from the platform. A preferred method of sensing launch is to have a contact pair between the cradle and the survival craft of which contact is broken when the craft begins to float off the cradle.

At this point also the system activates a sea water sprinkler to ensure a constant flow of water over the survival craft. This system is of particular significance in case of fire on the platform and possibly on the surrounding water.

Removal of the survival craft from the area of the platform is preferably conducted in two stages. In the first stage the craft is guided by the computer on a preset compass course, making use of an onboard compass to maintain the course. In the second stage, after a preset time has elapsed, the RDF takes over the course setting function, and the computer guides the craft according to signals received from the RDF. The theory here is that the craft will be guided on the preprogrammed compass course for a sufficient time to allow the craft to be well clear of the rig. The craft can then move on an RDF signal beam transmitted by the platform standby vessel.

The separation of the craft from the cradle also initiates in the computer the elapsed time counter which will determine the time during which the craft is controlled by the preprogrammed compass course.

The second survival craft, if also launched, is similarly computer controlled to move away from the platform to a prearranged area from which this craft also will be guided by the standby vessel RDF signal to effect a rendezvous. The initial computer controlled course will ensure that the survival craft is at all times well clear of the platform.

The survival craft is preferably provided with a radar transponder to enable the standby vessel to more easily locate the craft in the water. The transponder would also be activated automatically at launch.

Figure 2:
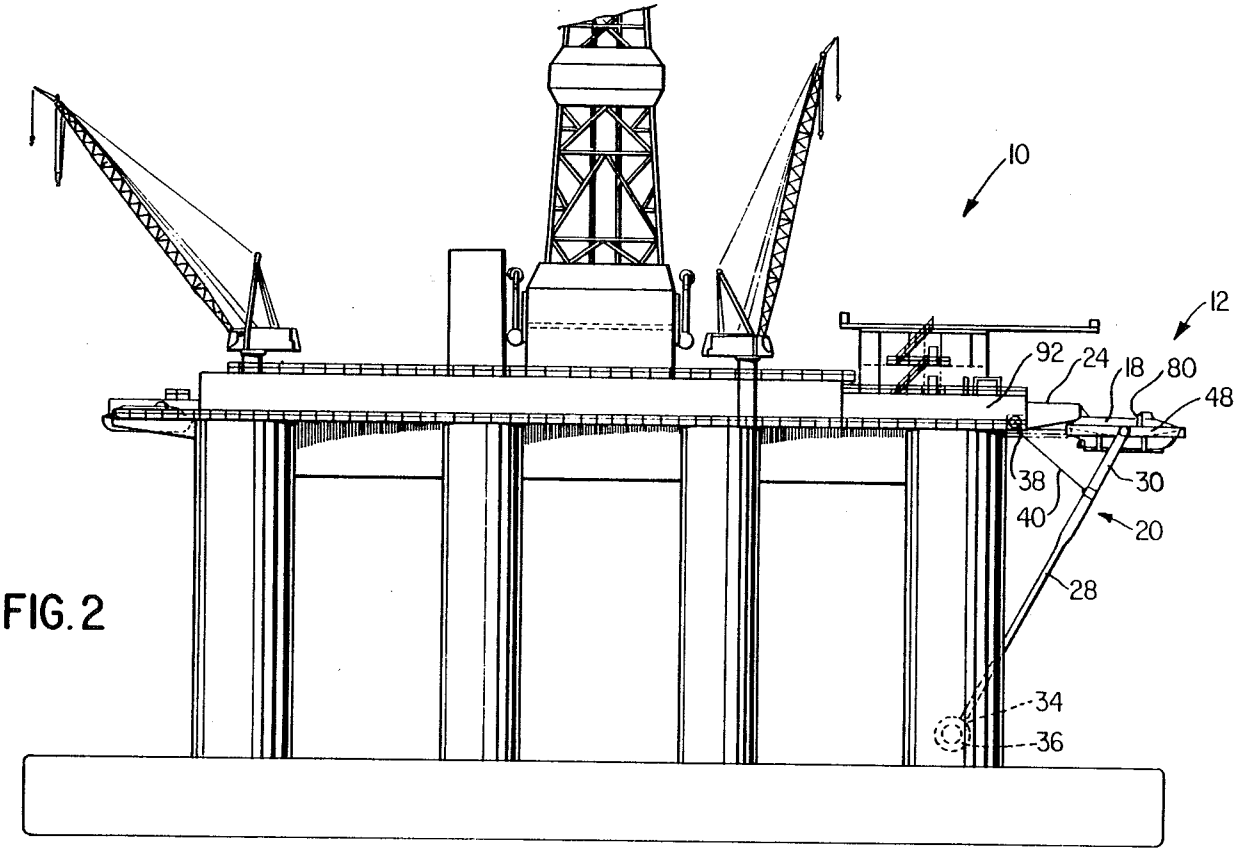
FIG. 2 is a side elevation of the platform of FIGURE 1.

With reference particularly to FIGS. 2 and 5, a closed passageway 24 is illustrated extending from the accommodation unit 92 to the rear of the survival craft 18. The passageway 24 is joined by air tight seals to the side wall 94 of the accommodation unit 92. As well, an airtight seal exists between the passageway 24 and the rear of the survival craft 18. The survival craft hatch 96 is within the sealed passageway.

A preferred location for the accommodation unit end of the passageway 24 is the mess area 98 in the accommodation unit 92. The hatchway 100 leading from mess area 98 to passageway 24 also has an airtight seal. Passageway 24 may also be provided with airtight hatches leading from the passageway to the deck 102 between the accommodation unit 92 and the end of platform 10.

The closed passageway provides a quick, obstruction-free means of moving from the accommodation area to the survival craft. At any time by far the majority of personnel on the platform will be located in the accommodation unit. Accordingly, the closed passageway provides direct access for those people from the accommodation unit for substantially horizontal or lateral entry into the survival craft. This factor can be of immense importance when keeping in mind that it will be only in extreme conditions that an evacution will take place. In these situations the deck area may be obscured by smoke, there may be fire aboard, high seas, wind and list may result in obstacles breaking loose and moving about the deck area, and there may be hazardous gases in the air. The use of the closed and sealed passageway will avoid all of these difficulties, and entry into the survival craft can be rapidly accomplished by a large crew.

It should be added that the location of the passageway can of course be varied to suit the particular configuration of the platform. As well, additional closed passageway can be located on other areas of the platform to avoid particular hazards.

The closed passageway also provides heated and protected storage for immersion suits and lifejackets. The primary source of these items would continue to be in the accommodation unit and as otherwise conventionally located. However, the additional supply of this evacuation equipment enables those not otherwise able to get to the equipment to obtain it immediately prior to boarding the survival craft. There has thus been described a complete system for fast and safe evacuation of a drilling platform. The system specifically avoids a substantial number of problems presented by earlier systems.

Thus it has been apparent that there has been provided in accordance with the invention an offshore evacuation system for drilling rigs or platforms that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. In combination with a vessel such as a drilling rig or production platform comprising a deck substantially above water level and having a crew accommodation unit on said deck, a survival craft, means for selectively supporting said survival craft adjacent to said deck and said accommodation unit and for lowering said survival craft to the water to thereby launch said survival craft, and means comprising a longitudinally extending passageway having ends, said ends sealing engaging said survival craft and said accommodation unit for enabling personnel to move outwardly from said accommodation unit to said survival craft supported by said supporting means, said passageway being substantially closed except for the ends thereof, said ends communicating with said survival craft and said accommodation unit, whereby entry of heat and/or matter into said passageway other than through said ends thereof is prevented, to thereby enable personnel to pass from said accommodation unit to said survival craft without exposure to weather, fire or noxious gases.

2. The combination of claim 1, wherein the supporting means comprises an A-frame having the legs thereof rotatably attached to the vessel below the deck, a cradle support secured to the outer end thereof, and at least one support cradle rotatably supported in said cradle support.

3. The combination of claim 2, said cradle support comprising an elongate member with its longitudinal axis transverse of and attached substantially at its mid point to the outer end of the A-frame, and a pair of spaced support members extending outwardly from said transverse member, all said members being substantially in the plane of said A-frame.

4. The combination of claim 1, in which said lowering means is a cable and winch system.

5. The combination of claim 1, in which the survival craft is totally enclosed and having a hatch enclosed by said passageway.

6. The combination of claim 1, including a sealable hatch between said accommodation unit and said passageway.

7. The combination of claim 6 in which said accommodation unit has a mess area, and wherein said sealable hatch leads from the mess area of said accommodation unit.

8. The combination of claim 1, and survival gear such as gas bottles, immersion suits and lifejackets in said passageway.

9. The combination of claim 1, said supporting means comprising a strut having upper and lower ends, means for pivotally connecting said lower end to said vessel, and means connected to said upper end of said strut for supporting a cradle, said survival craft being carried by said cradle, said supporting means extending only downwardly from said cradle.

10. The combination of claim 9, and further comprising means on said vessel for preventing upward movement of said survival craft when said survival craft is supported by said supporting means outboard of said deck.

11. The combination of claim 10, said supporting means supporting said survival craft with its longitudinal axis extending substantially perpendicularly to said platform.

12. The combination of claim 1, said supporting means supporting said survival craft with its longitudinal axis extending substantially perpendicularly to said platform.

13. The combination of claim 1, and further comprising a sealable hatch between said accommodation unit and said passageway.

14. The combination of claim 1, and further comprising a computer on said survival craft for monitoring environmental and platform conditions.

15. The combination of claim 14, in which said computer comprises means for. controlling movement of said supporting means for launching said survival craft.

16. In combination with a vessel such as a drilling rig or production platform comprising a deck with a crew accommodation unit thereon, (a) a survival craft, (b) a launch structure for a survival craft comprising:

(i) at least one support strut, (ii) means pivotally attaching one end of said support strut to the vessel below said deck, (iii) a cradle holding said survival craft, said cradle comprising members for engaging the bottom of the hull of said craft, (iv) means at the other end of said support strut for supporting said cradle, (v) said launch structure extending upwardly from said pivotal attaching means and extending only to said cradle, no part of said launch structure extending above the survival craft supported in said cradle, (c) cable means for controlling rotation of said launch structure from an upper position in which said cradle and survival craft are substantially at the level of the accommodation unit to a lower position in which said cradle deposits said survival craft into the sea, said cable means attached to said support strut below said cradle, and (d) a closed passageway extending from and in communication with the accommodation unit to and in communication with said survival craft when said survival craft is in said cradle and said launch structure is in the upper position thereof, said passageway being in sealing relationship with said accommodation unit and said survival craft.

17. In combination with a vessel such as a drilling rig or production platform comprising a deck and having a crew accommodation unit on said deck, a survival craft, supporting means for selectively supporting said survival craft outboard of said deck, lowering means for lowering said supporting means and said survival craft from adjacent to said deck into the water at a safe distance form the rig or platform to thereby launch said survival craft and avoid collision with the rig or platform after the launching thereof, and means comprising a longitudinally extending passageway for enabling personnel to move from said accommodation unit to said survival craft supported by said supporting means adjacent to said vessel and for containing life jackets, said passageway being substantially closed except for the ends thereof communicating with said survival craft and said deck and sealingly engaging said accommodation unit and survival craft for prevention entry of heat and/or matter into said passageway other than through said ends thereof.

18. The combination of claim 17, said supporting means supporting said survival craft from beneath said survival craft, and said lowering means lowering said supporting means below the surface of the water, whereby said survival craft can float off said supporting means.

19. The combination of claim 17, said supporting means comprising a cradle comprising at least one member for engaging the bottom of the hull of said survival craft.

20. The combination of claim 17, said passageway comprising means for permitting substantially only lateral entry of personnel into said survival craft.

* * * * *